United States Patent [19]

Graham et al.

[11] 4,207,548

[45] Jun. 10, 1980

[54] TUNED CIRCUITS

[75] Inventors: Peter B. Graham, Khandallah; Roger J. Butland, Miramar, both of New Zealand

[73] Assignee: Del Technology Limited, Wellington, New Zealand

[21] Appl. No.: 896,674

[22] Filed: Apr. 14, 1978

[30] Foreign Application Priority Data

Apr. 21, 1977 [NZ] New Zealand ..... 183919

[51] Int. Cl.[2] ..... H01P 7/04

[52] U.S. Cl. ..... 333/225; 333/226

[58] Field of Search ..... 333/82 B, 82 BT, 225, 333/226

[56] References Cited

U.S. PATENT DOCUMENTS

| | | | |
|---|---|---|---|
| 2,103,515 | 12/1937 | Conklin et al. | 333/83 BT |
| 2,544,674 | 3/1951 | Hagen et al. | 333/82 BT X |
| 2,594,895 | 4/1952 | Feiker, Jr. | 333/82 B X |
| 2,637,782 | 5/1953 | Maynuski | 333/82 B X |
| 2,666,185 | 1/1954 | Hulstede et al. | 333/82 B |

OTHER PUBLICATIONS

*Very High Frequency Techniques*, Harvard U. Radio Research Lab., McGraw-Hill, N.Y., 1947, vol. II, pp. 920-939.

*Primary Examiner*—Paul L. Gensler

*Attorney, Agent, or Firm*—Haseltine, Lake & Waters

[57] ABSTRACT

A coaxial resonator is provided having an outer conductor with top and bottom closures and a substantially central opening through the top closure through which a tubular member forming a center conductor extends. The center conductor also comprises a plunger which is moveable within the tubular member such that the electrical length of the center conductor can be varied to effect tuning of the resonator.

The tubular member and the plunger are spaced apart in slidable relationship one with the other and as the bottom end of the tubular member represents essentially a short circuit, at that point there is no physical electrical contact provided between the tubular member and the plunger, thus overcoming several disadvantages of prior art resonators which utilized "finger" electrical contact at that point.

1 Claim, 2 Drawing Figures

TUNED CIRCUITS

This invention relates to tuning machanisms for coaxial resonators.

It is known in the art to which this present invention relates to provide a tuned circuit in the form of a coaxial resonator in which tuning is effected by adjusting the length of two telescoped conductors forming a central conductor located within an outer conductor of much larger diameter.

Such coaxial resonators are described for example in "Communications," Aug. 1949 pages 8 to 11 and in U.S. Pat. No. 2,637,782 of H. Magnuski filed Nov. 28, 1947.

However, it has been found that such resonators can have certain disadvantages especially with regard to compensation for temperature variation in the tuning and also in the manner in which tuning is effected.

It is thus an object of the present invention to provide a tuning mechanism for a coaxial resonator to overcome at least in part, some of the disadvantages of coaxial resonators to the present time.

Further objects of this invention will become apparent from the following description.

According to one aspect of the present invention there is thus provided a tuning mechanism for a coaxial resonator comprising a center conductor which includes a slidable plunger having a free end thereof adjustably extendible from an adjacent end of a tubular conductor so as to vary the effective length of said center conductor and to tune said resonator to a required frequency, and in which at said adjacent end of said tubular conductor essentially a short circuit is presented and whereat no physical electrical contact between said tubular conductor and said plunger is present.

Further aspects of this invention, which should be considered in all its novel aspects, will become apparent from the following description, given by way of example of preferred embodiments of the invention in which reference is made to the accompanying drawings, wherein.

The present invention provides a coaxial resonator having an outer conductor which may be formed as a cylindrical can having top and bottom closures with a substantially central opening in the top closure through which a tubular member forming a center conductor extends.

The center conductor comprises a plunger which is moveable within said tubular member such that the electrical length of said center conductor can vary to effect tuning of the resonator.

A pair of coupling loops provide the respective input and output to the resonator and these loops are secured to a top closre of the can and extend downwardly thereinto. Alternatively, the coupling loops may extend laterally from the can as shown in the aforementioned U.S. Patent, this being of advantage electrically in providing less variation in loaded "Q" over the tuning range but having some disadvantage in the mechanical design resulting.

The tubular member and the plunger are spaced apart in slidable relationship one with the other and as a bottom end of said tubular member represents essentially a short circuit, at that point there is no physical electrical contact provided between the tubular member and the plunger. In this regard a 'finger' electrical contact between the plunger and the tubular member has been provided in previously known resonators. The lack of this electrical contact between the tubular member and the plunger, it has been found, overcomes several disadvantages of prior art resonators, in, eliminating variation in the tuning due to vibration, minimizing electrical noise due to contact resistance, providing a much smoother tuning operation and also of course not setting any limit as to the number of tuning operations that can be carried out due to physical wear which would otherwise take place at the electrical contact surfaces.

A double compensation against temperature variation can be provided by altering the position at which a rod of the plunger is secured thereto, thus providing a substantially zero temperature coefficient of expansion at the central frequency of tuning.

A support in the form of a disc or radial arms for the tubular member may be provided thereabout which support may be in the form of a suitable low loss dielectric material such as PTFE (polytetrafluroethylene) or polyethylene.

The tuning of the resonator may be accomplished by the releasing of one or more locking nuts which may secure the rod of the plunger in a fixed position relative to the tubular member and whereby upon movement of the plunger rod the extension of the plunger out of the tubular member and into the cavity can be increased or shortened so as to adjust the frequency to which the resonator is tuned.

Figure 1:
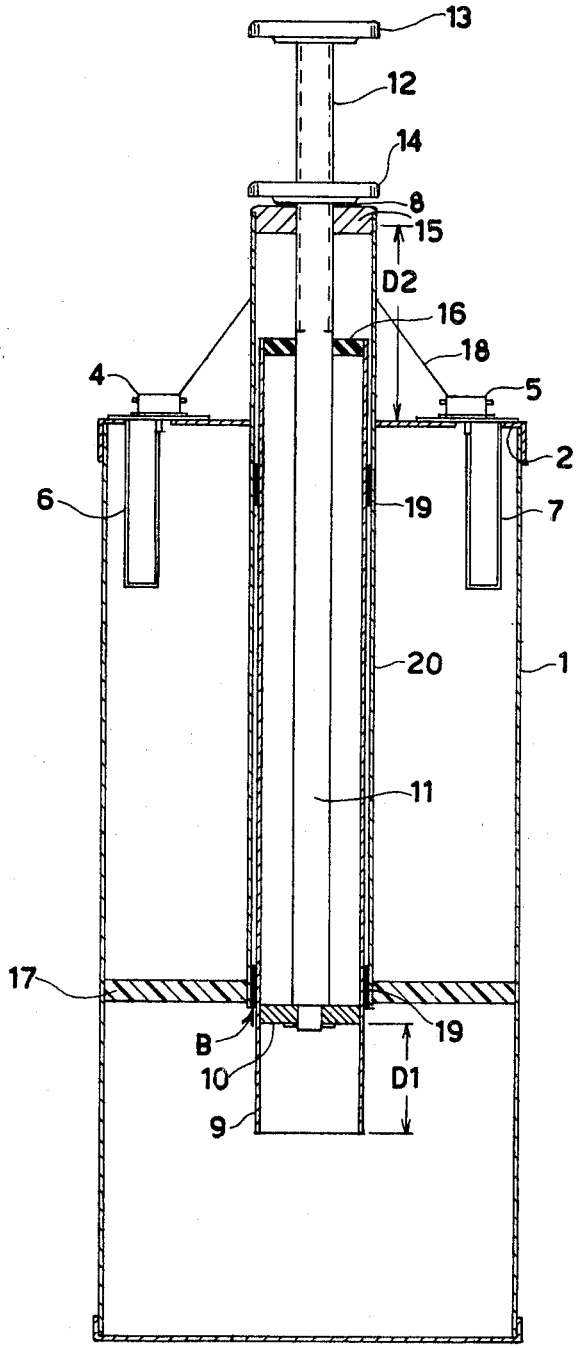
FIG. 1 shows a side elevational cross-sectional view through a coaxial resonator according to one embodiment of the invention.

Turning now to FIG. 1 of the accompanying drawings a coaxial resonator according to one embodiment of the invention comprises an outer conductor 1, for example in the form of a cylindrical can, which has a closed bottom end and a closed top end 2 the latter of which has input and output terminals 4 and 5 respectively connected with respective coupling loops 6 and 7. The loops 6 and 7 would be suitably of a low impedance, for example 50 ohms. A pair of gussets 18, which are an optional feature, are shown connecting the top end 2 of the coaxial resonator with a tubular inner conductor 20 which includes therein a slidable plunger 9 which may be closed off at the free end thereof if desired by a cap (not shown). The end 2 may alternatively be stiffened by laminations and the gussets omitted. The plunger 9 is connected with a shorting plug 10, for example of brass, at the end of a rod 11 of a low expansion metal such as Invar. The rod 11 may, if of Invar or like metal of low electrical conductivity, be coated with a high conductivity coating of for example, copper or silver. Also, a gold flashing or a chemically inert coating may also be provided as an outer corrosion resistant cover. The rod 11 extends through a dielectric support 16 and is threaded at an upper end 12 thereof. A locking nut 14 is secured to the rod 11, together with a tuning knob 13 at its free end. The locking nut 14 may abut a washer 8, as shown interposed between the nut 14 and a sealing plug 15 positioned at one end of the tubular member 20. The purpose of the washer 8 may be to keep apart the metals of nut 14 and plug 15 which may be dissimilar and to also obviate possible loosening of the nut 14 during temperature cycling of the resonator. The plug 15 is of brass or like material and seals the cavity against stray R.F.

Spacers 19 of any suitable material, for example PTFE, are shown provided between the plunger 9 and the tubular conductor 20 while a support 17 is shown located between the tubular conductor 20 and the outer conductor 1. The support 17 may suitably be of a low-loss dielectric material such as PTFE, polyurethane or polyethylene.

The center conductor and the plunger provide a three section compound transmission line comprising, sequentially, (a) a low impedance line essentially one quarter wavelength defined by the outer surface of the plunger 9 and the inner surface of the tubular conductor 20, (b) a short re-entrant length of high impedance line defined by the inner surface of the tubular conductor 20, the surface of the rod 11 and the adjacent end surface of the plunger 9 and (c) the inner surface of the plunger 9 and the surface of the rod 11 and which presents essentially a short circuit at the point referenced B and thus no electrical contact is required between the tubular conductor 20 and the plunger 9 as would otherwise be the case. This lack of electrical contact has several advantages as mentioned hereinabove.

For a discussion regarding the compound lines reference may be made to "Very High Frequency Techniques" Harvard University Radio Research Laboratory Staff—McGraw Hill Book Co. Inc., N.Y. (1947) pages 920–939.

A double compensation against temperature variation and the tuning of the cavity resonator may be provided by appropriate adjustment of the distances referenced D1 and D2 in FIG. 1. This can be accomplished by an adjustment of the securement of plunger rod 11 and shorting plug 10 with a plunger 9, thus changing the distance D1 and, at a central frequency of tuning providing a distance D2. This in turn provides a substantially zero temperature coefficient of expansion at this central frequency, the relationship then existing between distances D1 and D2 being as follows:

With $l_t$ being the distance referenced D2 in FIG. 1, $l_e$ being the distance referenced D1 in FIG. 1 and $l_m'$ being the distance between top end closure 2 and the bottom end of plunger 9, to a first approximation, the constant frequency operation of the resonator, at center band frequency as shown in FIG. 1, is dependent upon $l_m'$ being constant for a change in temperature $\Delta t°$ C.

The change in length of $l_m'$ in a composite structure with rod 1 being of a low coefficient of expansion material, such as Invar, and the rest being of a relatively high coefficient of expansion material, such as Copper, is given by:

$$\Delta l_m' = \alpha_{comp} l_m' \Delta t$$

where $\alpha_{comp}$= composite coefficient of expansion of the central tuning mechanism.

With rod 11 fixed as shown $$\Delta l_m' = [\alpha_c l_e + \alpha_i [l_m' - le + lt] - \alpha_c l_t] \Delta t = \alpha_{comp} l_m' \Delta t$$

where $\alpha_c$=coefficient of expansion of Copper=$17.7\times10^{-6}$[°C.]$^{-1}$ $\alpha_i$=coefficient of expansion of Invar=$1.6\times10^{-6}$[°C.]$^{-1}$ The aim is to have $\Delta lm'=0$, thus $\alpha_{comp}=0$ Then $\alpha_c l_e + \alpha_i l_m' - \alpha_i l_e + \Delta_i l_t - \alpha_c l_t = 0$ which reduces to $$(\alpha_c - \alpha_i)/\alpha_i = l_m'/(l_t - l_e)$$

substituting actual values of $\alpha$ and rearranging gives $$l_e = l_t - l_m'/10.1$$

For a general discussion of temperature effects on cavities reference may be made to; Montgomery, C. G. ed. "Technique of Microwave Measurement," London, Dover Publication, 1966, pages 384–390.

Figure 2:
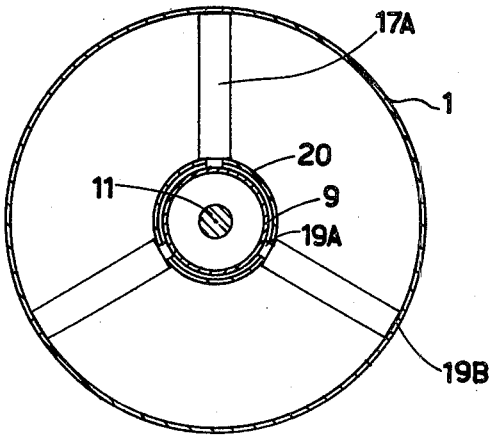
FIG. 2 shows an end cross-sectional view through a coaxial resonator according to a further embodiment of the invention.

Turning now to FIG. 2 of the accompanying drawings in an alternative embodiment of coaxial resonators the support disc 17 of FIG. 1 of low-loss dielectric material has been replaced by a plurality, three being shown, of equally spaced low-loss dielectric rods or arms which support the tube 20.

The bottom bearing surface provided in FIG. 1 by means of bottom spacer 19 may now instead be provided as shown by means of protrusions 19A extending inwardly from the inner ends of the rods or arms 17A. The protrusions 19A are shown extending through the tubular conductor 20 to abut the outer surface of the plunger 9 and also serve to locate the rods or arms 17A in the tubular conductor 20.

This modified support while serving to hold the tubular conductor 20, plunger 9 and can 1 in their correct relationship one with the other also minimizes the amount of dielectric material used in the resonator to thus reduce electrical losses in the resonator especially at the higher frequencies of operation.

It will be appreciated that it is necessary to provide a good mechanical and electrical joint between the top closure 2 and the tubular conductor 20.

Previous techniques in providing such a joint have included brazing or soldering and subsequent silver plating. Such techniques may be found to be unsatisfactory in that they can result in the heating up of the joint which detracts from the mechanical strength of the joint members. Also, the use of flux in providing such a joint can produce in some cases a long term effect with regard to corrosion. Such previous techniques may thus be seen to be not entirely satisfactory where, as in the present case, high mechanical strength and high electrical conductivity is required for the joints between the top closure 2 and the conductor 20.

It has been found that this joint can be provided with the desired electrical conductivity and mechanical strength by the crimping of the tubular conductor 20 about its entry through the top closure 2. For this purpose a pair of spaced apart toroids of polyurethane material can be mounted on a ram and inserted into the tubular conductor 20 and upon compression of the ram these toroids can be compressed so as to deform or bulge outwardly such that the tubular conductor 20 is correspondingly axially deformed on either side of its entry into the top surround 2 with the result that the tubular conductor 20 is firmly held in position within the top surround 2. It has been found that such a joint has a high degree of both mechanical strength and high electrical conductivity as is desirable in the present instance.

Where in the aforegoing description mention has been made of specific components or integers of the tuning mechanism of the coaxial resonator of the present invention in respect of which known equivalents in the art to which the present invention relates exist then such equivalents are incorporated herein as if individually set forth.

Although this invention has been described by way of example and with reference to one embodiment of the invention it is to be understood that modifications and improvements may be made thereto without departing from the scope of the invention.

We claim:

1. A tuning mechanism for a coaxial resonator comprising: a center conductor, said center conductor includes a slidable hollow plunger slidable with an electrically conductive rod extending through the plunger and passing at one end through an electrically conductive sealing plug for sealing the rod with a surrounding tubular conductor; said plunger is secured at its opposite end with a shorting plug that shorts the plunger and rod, the plunger having a free end thereof adjustably extendible from an adjacent end of a tubular conductor so as to vary the effective length of said center conductor and to tune said resonator to a required frequency, and in which at said adjacent end of said tubular conductor essentially a short circuit is presented by a three section compound transmission line comprising, sequentially, (a) a low impedance line essentially one quarter wavelength defined by the outer surface of the said plunger and the inner surface of the said tubular conductor, (b) a short re-entrant length of high impedance line defined by the inner surface of the said tubular conductor, the surface of the said rod and the adjacent end surface of the said plunger and (c) the inner surface of said plunger and the surface of said rod, the compound transmission line being terminated by the said shorting plug, and whereat no physical electrical contact between said tubular conductor and said plunger is present.

* * * * *